US005511773A

United States Patent [19]

Burger

[11] Patent Number: 5,511,773

[45] Date of Patent: Apr. 30, 1996

[54] COMPENSATING SUPPORT ARRANGEMENT

[76] Inventor: Manfred Burger, Bahngasse 2/11, A-2320 Schwechat, Austria

[21] Appl. No.: 190,145

[22] PCT Filed: May 27, 1993

[86] PCT No.: PCT/EP93/01331

§ 371 Date: Feb. 4, 1994

§ 102(e) Date: Feb. 4, 1994

[87] PCT Pub. No.: WO93/25459

PCT Pub. Date: Dec. 23, 1993

[30] Foreign Application Priority Data

Jun. 12, 1992 [AU] Australia ..... 1201/92

[51] Int. Cl.[6] ..... B65H 1/08

[52] U.S. Cl. ..... 271/148; 271/160; 271/30.1

[58] Field of Search ..... 271/148, 160, 271/30.1, 94

[56] References Cited

U.S. PATENT DOCUMENTS

| | | | |
|---|---|---|---|
| 3,260,521 | 7/1966 | Moxness | 271/148 |
| 3,446,500 | 5/1969 | Meier | 271/148 |
| 3,572,686 | 3/1971 | Day | 271/94 |
| 4,188,026 | 2/1980 | Nagai | 271/148 |
| 4,345,752 | 8/1982 | Nakamura et al. | 271/94 |
| 4,699,369 | 10/1987 | Zirilli | 271/94 |
| 4,744,472 | 5/1988 | Pfister | 271/148 |
| 4,942,435 | 7/1990 | Kneisel et al. | 271/148 |

FOREIGN PATENT DOCUMENTS

| | | | |
|---|---|---|---|
| 0499283 | 8/1982 | European Pat. Off. . | |
| 0078013 | 5/1984 | Japan | 271/148 |
| 59-138535 | 8/1984 | Japan . | |
| 0190126 | 10/1984 | Japan | 271/160 |

OTHER PUBLICATIONS

Patent Abstract of Japan, vol. 14, No. 361 (M–1006)(4303) 6 Aug. 1990 JP 2–127325 (NEC Corp.) 16 May 1990.

*Primary Examiner*—H. Grant Skaggs

*Attorney, Agent, or Firm*—McAulay Fisher Nissen, Goldberg & Kiel

[57] ABSTRACT

A compensating support arrangement for a printing machine for printing envelopes has the uppermost envelope of an envelope stack rest on a movable top surface which is brought into a horizontal position and the means of a suction device to the printing apparatus. For producing the horizontal position, a bottom surface is provided, to which is fixed at least one spring holder with at least one adjustable and replaceable spring element, which carries and supports the top surface.

18 Claims, 3 Drawing Sheets

COMPENSATING SUPPORT ARRANGEMENT

BACKGROUND OF THE INVENTION a) Field of the Invention

The invention relates to a compensating or adjusting support arrangement such as for a stacking table for a printing machine for printing envelopes, the top envelope of an envelope stack resting on a movable top surface being brought into a horizontal position and supplied by means of a suction device to the printing apparatus. The inventive arrangement may be in the form of a supplementary device for the printing machines. Such supplementary devices are suitable for printing machines for all standard printing procedures, i.e. letterpress, litho, screen and photogravure.

b) Background Art

In standard printing machines for envelopes, the envelopes are stacked in large numbers and conveyed via a suction feeder to the feed table on which the printing process is carried out. When stacking a large number of envelopes, a level difference occurs because of their flaps and/or multilayer gluing when unidirectionally positioned, the thicker areas of the envelopes are higher than the thinner areas and therefore it is not possible to ensure a horizontal position of the top envelope taken from the suction device. As a result, there is only a poor suction effect on the envelope and the printing process can no longer take place in a precise and accurate manner.

In order to prevent this, compensation is necessary and this has been done in the past by using, prior to the printing press, rollers, wedges or the like which are placed between the envelopes in the envelope stack and during the printing process, have to be regularly manually removed. Therefore, someone must always be present at the printing machine throughout the printing process.

OBJECT AND SUMMARY OF THE INVENTION

The primary object of the invention is therefore to provide an arrangement or apparatus of the aforementioned type, which ensures a level compensation of the envelope stack in such a way that the top envelope to be taken from the suction device is positioned horizontally and, consequently, there is no need to insert and remove rollers, wedges or the like, or for the permanent presence of a person.

This object is achieved in that, in the case of such compensating support arrangement a bottom surface is provided on which is fixed at least one spring holder or retainer with at least one adjustable and replaceable spring element, which supports the top surface.

This construction of the compensating support arrangement achieves the object of having the top envelope horizontally oriented, in that, as a function of the height of the envelope stack, the top surface is adjusted in accordance with the different thickness.

Thus, in accordance with the invention, a compensating support arrangement for a stack of envelopes located on a stacking table of a printer for aligning the uppermost envelope for a take-off suction device of the printer arranged above the envelope with operational accuracy comprises a base plate adapted to be supported on the stacking table, a bearing table arranged at a distance above the base plate and provided for the support of the envelope stack, at least one spring element arranged between the base plate and bearing plate and means for holding and guiding the bearing plate in position relative to the base plate.

Also in accordance with the invention, in a printing machine for printing on a variety of paper products including envelopes, said printing machine having a stacking table for aligning an uppermost envelope of an envelope stack and a take-off suction device arranged above the uppermost envelope of the stack for removing said uppermost envelope with operational accuracy, the improvement comprising a compensating support arrangement to assure that the uppermost envelope of the stack is essentially horizontal when removed by the take-off suction device. The compensating support arrangement includes a base plate supported by the stacking table, a bearing plate arranged at a distance above the base plate and provided for support of the envelope stack, at least one spring element arranged between the base plate and bearing plate and means for holding and guiding the bearing plate in position relative to the base plate.

According to an advantageous further development of the invention, on one side, the top surface is connected in articulated manner with a lateral surface of the apparatus and, on the opposite side, is supported by a spring element. The previously described construction ensures a particularly simple embodiment of the envelope adjusting mechanism, which is inexpensive to manufacture.

According to a further advantageous development of the invention the top surface is held on one wide side by two spring elements and on the other by a spider or capstan. This embodiment not only permits a one-sided level compensation, but also such compensation on all four sides.

Finally, according to another development of the invention, the top surface, on one wide side, is held by a spring element and, on the other side, by a capstan or spider and, in the center of the bottom surface, a fixed linkage is secured guided by the top surface and having a movable supporting surface.

Apart from the above-described level compensation, compensating support arrangement also prevents the envelope from sagging in its central area and ensures that there is a horizontal or planar positioning of the top envelope.

For a better understanding of the present invention, reference is made to the following description and accompanying drawings while the scope of the invention will be pointed out in the appended claims.

DESCRIPTION OF THE PREFERRED EMBODIMENTS

Figure 1:
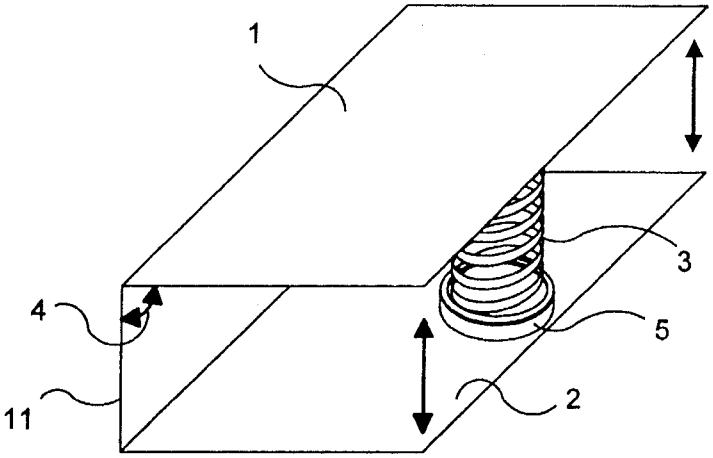
FIG. 1 illustrates a diagrammatic representation of a first embodiment of the compensating support arrangement.

The compensating support arrangements shown in the drawings, in essence, have a bottom surface or base plate 2 and a top surface or bearing plate 1, on which comes to rest the envelope stack and, as a function of the particular embodiment, one or more spring elements 3 and a further support element, namely a movable capstan or spider 8, as well as a fixed linkage 9 with a movable supporting surface 10. Bearing plate 1 has a supporting surface which supports the envelope stack and which lies substantially in one plane.

Figure 2A:
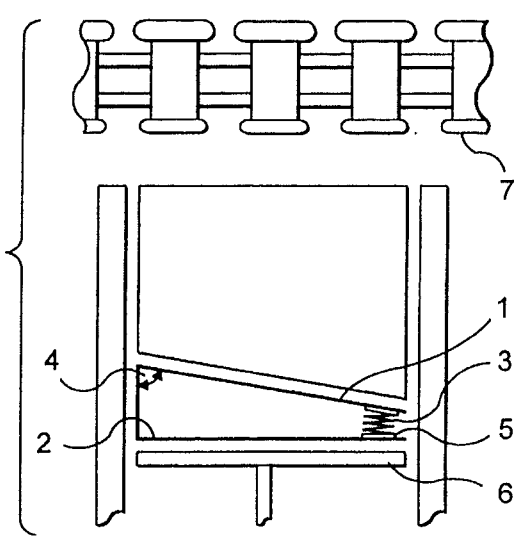
FIG. 2 illustrates a diagrammatic representation of the compensating support arrangement in three positions and with different envelope stack heights.
Figure 2B:
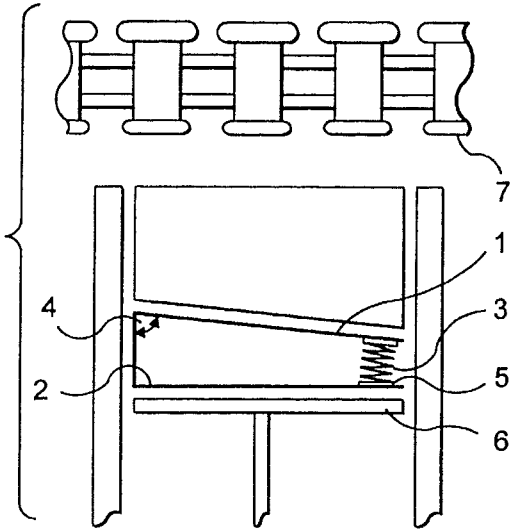
Figure 2C:
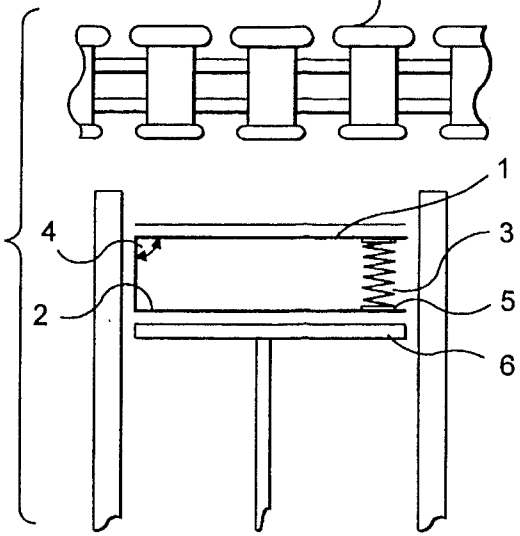

The embodiment diagrammatically shown in FIGS. 1 and 2 shows a bottom surface 2 means for holding and guiding bearing plate 1 in position relative to base plate 2 which is illustrated as, a leg or legs 11, a bearing plate 1, which is made movable by a joint 4, as well as a spring element 3, which is located in a spring retainer or holder 5 between the base plate 2 and the bearing plate 1.

In the case of DIN C 5/6 format envelopes, the envelope flap located either on the long or on the wide side causes a greater pressure in this area. This fact is now utilized in that on the side where the flap is located and the pressure is higher, on the movable bearing plate 1, the spring element 3 brings about an inclining of the envelope, which is compensated up to the top envelope in the stack, so that the then top envelope, which is received from the suction device 7, is positioned horizontally.

Figure 3:
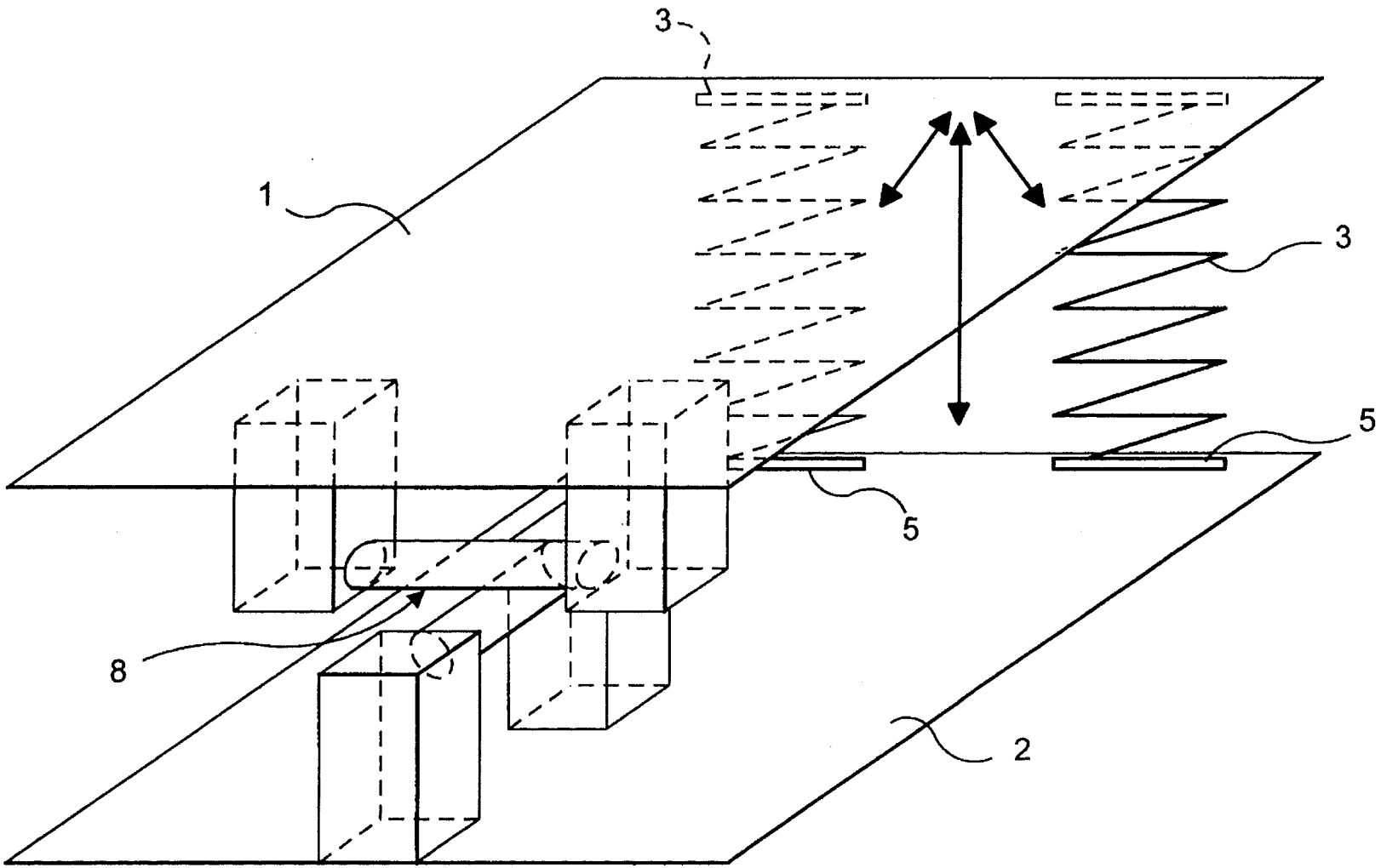
FIG. 3 illustrates a diagrammatic representation of a second embodiment of the compensating support arrangement.

In the case of the second envelope adjusting mechanism embodiment shown in FIG. 3, on the base plate 2 there are two spring elements 3 in spring retainers or holders 5, as well as means for holding and guiding bearing plate 1 in position relative to base plate 2, namely a movable capstan 8, which produces the connection with the bearing plate 1. The envelope stack, not shown in FIG. 3, again rests on the bearing plate 1.

This embodiment serves to bring about the horizontal positioning of the top DIN C 5 format envelope on the envelope stack. These envelopes are folded on a long side and a narrow side, folded on the other long side and glued in three-layer form, while on the second narrow side on which the flap is located, the fold is added to the three-layer structure. This means that the level differences, in contrast to the first-described embodiment, not only occurs on one long side and one narrow side, but instead the level difference when stacking the envelopes occurs in different form on all four sides. Thus, the compensation must cover all sides of the envelope. Thus, between the bearing plate 1 and the base plate 2 are provided at least two spring elements 3, which fundamentally fulfil the same function as in the first embodiment, but additionally a movable support element, namely a movable capstan 8 is installed, which ensures that the bearing plate 1 can move upwards or downwards in each direction of any side, as a function of the pressure increase caused by the number of layers and folds. Capstan 8 is a means for holding and guiding bearing plate 1 in position relative to base plate 2. Thus, as in the first embodiment, the top envelope in the stack is received in the horizontal position from the suction device.

Figure 4:
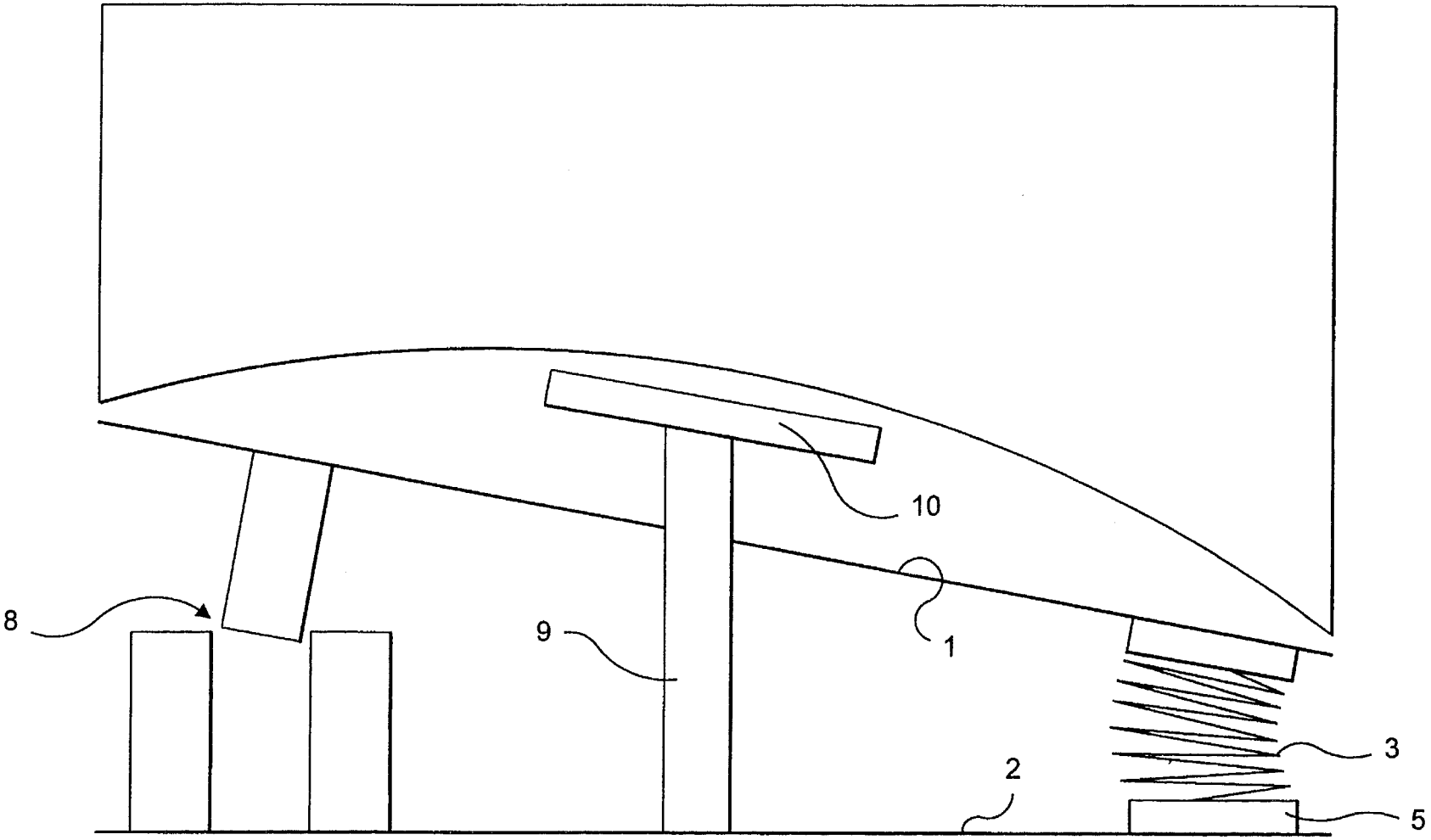
FIG. 4 illustrates a diagrammatic representation of a third embodiment of the compensating support arrangement.

In the case of the third embodiment shown in FIG. 4 between the bearing plate 1 and the base plate 2, there are once again spring elements 3 in spring retainers 5, as well as a movable capstan 8. In addition, between the spring elements 3 and the capstan 8 in the center of the bottom surface 2 is fitted a fixed linkage 9 guided by the bearing plate 1 and to which is applied a movable supporting surface 10. This embodiment solves the following problem.

In the case of DIN C 4 envelopes and larger, the problem arises that as from a certain number of stacked envelopes, due to the limited physical nature of the envelopes, they sag and consequently it is not possible to ensure the horizontal position of the top envelope in the stack. Thus, in contrast to the last-described embodiment, it is not sufficient to bring about level compensation by means of spring elements 3 and the movable capstan 8. In addition there is the effect of the movable supporting surface 10 on the fixed linkage 9. As can be gathered from FIG. 4, the envelope stack mainly rests on the supporting surface 10 of the fixed linkage 9. An opening is provided in the bearing plate 1 through which the fixed linkage 9 projects, and, as a result of the function of the spring elements 3 and the movable capstan 8, the bearing plate 1 is movable, so that the level compensation is, on the one hand; and, ensured by the spring elements 3 and, the movable capstan 8 and, on the other, by the fixed linkage 9 with the movable supporting surface 10.

Thus, as described for the different embodiments of the compensating support arrangement, the top envelope of the stack in each case is received in the horizontal position from the suction device.

While the foregoing description and drawings represent the preferred embodiments of the present invention, it will be obvious to those skilled in the art that various changes and modifications may be made therein without departing from the true spirit and scope of the present invention.

I claim:

1. A compensating support arrangement for a stack of envelopes located on a stacking table of a printer for aligning an uppermost envelope for a take-off suction device of the printer arranged above the uppermost envelope with operational accuracy, comprising:

a base plate adapted to be supported on the stacking table;

a bearing plate arranged at a distance above the base plate and providing a support surface for supporting the envelope stack, said support surface being arranged substantially in one plane;

at least one spring element arranged between the base plate and bearing plate adapted for lifting the uppermost envelope into alignment with the suction device; and means for holding and guiding the bearing plate in position relative to said base plate, said bearing plate being moveable between unloaded and loaded positions relative to said base plate, said bearing plate being substantially parallel to said base plate while occupying said unloaded position.

2. The compensating support arrangement according to claim 1, wherein said means for holding and guiding the bearing plate is constructed as a leg which is arranged at one edge of said base plate and directed to an angle of approximately 90° to the bearing plate, said bearing plate being swivelably fastened at the leg.

3. The compensating support arrangement according to claim 2, wherein said leg is constructed as a side surface.

4. The compensating support arrangement according to claim 1, wherein said spring element is constructed as a spiral spring and is fastened by its ends at the upper side of said base plate in holders provided therein.

5. The compensating support arrangement according to claim 1, wherein said spring element is constructed as a spiral spring and is fastened by its ends at the underside of the bearing plate in holders provided therein.

6. The compensating support arrangement according to claim 1, wherein said means for holding and guiding the bearing plate is constructed as a joint arranged between the upper side of the base plate and the underside of the bearing plate.

7. The compensating support arrangement according to claim 6, wherein said joint is a three-dimensional joint in the form of a universal joint.

8. A compensating support arrangement for a stack of envelopes located on a stacking table of a printer for aligning an uppermost envelope for a take-off suction device of the printer arranged above the uppermost envelope with operational accuracy, comprising:

a base plate adapted to be supported on the stacking table;

a bearing plate arranged at a distance above the base plate and providing a support surface for supporting the envelope stack;

at least two spring elements arranged between the base plate and bearing plate, said spring elements being adapted for lifting the uppermost envelope into alignment with the suction device; and means for positioning the bearing plate relative to said base plate, said bearing plate being moveable between unloaded and loaded positions relative to said base plate, said bearing plate being substantially parallel to said base plate while occupying said unloaded position and said means for positioning the bearing plate relative to the base plate comprises a support which is arranged on the base plate, said support projecting through an opening formed in the bearing plate and being adapted to provide support to the envelope stack.

9. The compensating support arrangement according to claim 8, wherein said support has a supporting surface constructed so as to be moveable.

10. In a printing machine for printing on a variety of paper products including envelopes, said printing machine having a stacking table for aligning an uppermost envelope of an envelope stack and a take-off suction device arranged above the uppermost envelope of the stack for removing said uppermost envelope with operational accuracy, the improvement comprising a compensating support arrangement to assure that the uppermost envelope of the stack is substantially parallel to the stacking table when removed by the take-off suction device, said compensating support arrangement comprising:

a base plate being supported by said stacking table;

a bearing plate arranged at a distance above said base plate and having a support surface provided for support of the envelope stack, said support surface being arranged in substantially one plane;

at least one spring element arranged between said base plate and said bearing plate for lifting the uppermost envelope into alignment with the suction device and means for holding and guiding the bearing plate in position relative to the base plate, said bearing plate being moveable between unloaded and loaded positions relative to said base plate, said bearing plate being substantially parallel to said base plate while occupying said unloaded position.

11. The printing machine according to claim 10, wherein said means for holding and guiding the bearing plate is constructed as a leg which is arranged at one edge of said base plate and directed at an angle of approximately 90° to the bearing plate, said bearing plate being swivelably fastened at the leg.

12. The printing machine according to claim 11, wherein said leg is constructed as a side surface.

13. The printing machine according to claim 10, wherein said spring element is constructed as a spiral spring and is fastened by its ends at the upper side of said base plate in holders provided therein.

14. The printing machine according to claim 10, wherein said spring element is constructed as a spiral spring and is fastened by its ends at the underside of the bearing plate in holders provided therein.

15. The printing machine according to claim 10, wherein said means for holding and guiding the bearing plate is constructed as a joint arranged between the upper side of the base plate and the underside of the bearing plate.

16. The printing machine according to claim 15, wherein said joint is a three-dimensional joint in the form of a universal joint.

17. The printing machine according to claim 10, wherein the bearing plate is supported on the base plate by two spring elements arranged in the corners of the plates, and means for holding and guiding the position of the bearing plate relative to the base plate is constructed as a support which is arranged on the base plate, said support projecting through an opening formed in the bearing plate to support said stack of envelopes.

18. The printing machine according to claim 17, wherein said support has a supporting surface constructed so as to be movable.

* * * * *

UNITED STATES PATENT AND TRADEMARK OFFICE

CERTIFICATE OF CORRECTION

PATENT NO. : 5,511,773
DATED : April 30, 1996
INVENTOR(S) : Manfred Burger

It is certified that error appears in the above-identified patent and that said Letters Patent is hereby corrected as shown below:

In the title page, Item [30], change "[AU] Australia" to read

--[AT] Austria--.

Signed and Sealed this

Tenth Day of September, 1996

*Attest:*

Bruce Lehman

BRUCE LEHMAN

*Attesting Officer*

*Commissioner of Patents and Trademarks*